US009450325B1

(12) United States Patent
Lai

(10) Patent No.: US 9,450,325 B1
(45) Date of Patent: Sep. 20, 2016

(54) POWER SOCKET STRUCTURE

(71) Applicant: Li-Chun Lai, New Taipei (TW)

(72) Inventor: Li-Chun Lai, New Taipei (TW)

( * ) Notice: Subject to any disclaimer, the term of this patent is extended or adjusted under 35 U.S.C. 154(b) by 0 days.

(21) Appl. No.: 14/857,591

(22) Filed: Sep. 17, 2015

(51) Int. Cl.
*H01R 13/44* (2006.01)
*H01R 13/453* (2006.01)
*H01R 24/78* (2011.01)

(52) U.S. Cl.
CPC ..... *H01R 13/4534* (2013.01); *H01R 24/78* (2013.01)

(58) Field of Classification Search
CPC ..... H01R 13/4534; H01R 24/78
USPC ..... 439/134–141
See application file for complete search history.

(56) References Cited

U.S. PATENT DOCUMENTS 5,393,239 A * 2/1995 Ursich ..... H01R 13/20 439/180
6,786,753 B1 * 9/2004 Lai ..... H01R 13/6392 439/270
6,805,572 B1 * 10/2004 Lai ..... H01R 13/639 439/348
7,588,447 B1 * 9/2009 Ni ..... H01R 13/4534 439/137
7,985,085 B2 * 7/2011 Gao ..... H01R 13/4534 439/137
8,147,260 B2 * 4/2012 Huang ..... H01R 13/4534 439/140
8,242,362 B2 * 8/2012 Castaldo ..... H01R 13/4534 174/53
8,366,463 B2 * 2/2013 Zhang ..... H01R 13/4534 439/135
8,535,102 B1 * 9/2013 Colahan ..... H01R 31/06 439/5
8,550,829 B2 * 10/2013 Huang ..... H01R 13/4534 439/127
9,059,529 B1 6/2015 Lai
9,059,530 B2 * 6/2015 Byrne ..... H01R 13/4534
9,160,124 B2 * 10/2015 Colahan ..... H01R 31/06
2012/0083143 A1 * 4/2012 Jiang ..... H01R 13/4534 439/137

* cited by examiner

*Primary Examiner* — Briggette R Hammond
*Assistant Examiner* — Milagros Jeancharles
(74) *Attorney, Agent, or Firm* — WPAT, P.C., Intellectual Property Attorneys; Anthony King

(57) ABSTRACT

A power socket structure comprises a base seat, a top lid, a safety gate and an elastic component, wherein the base seat includes a first electrode and a second electrode, the safety gate can be movably placed on a supportive platform of the base seat, the top lid has a first plug-in hole and a second plug-in hole, and the top lid covers the base seat such that the safety gate is located between the top lid and the base seat, and the gate body of the safety gate masks the first electrode and the second electrode at the normal position. In addition, the safety gate includes a first slope and a second slope, so that, in case any one of the first plug-in hole or the second plug-in hole is inserted, it can sway about the rolling component of the safety gate acting as the center thereby maintaining the relationship of masking the first electrode and the second electrode. Thus, only when the electric power plug is correctly inserted can it be possible to push the safety gate away from the normal position to an application position via the first slope.

6 Claims, 8 Drawing Sheets

POWER SOCKET STRUCTURE

BACKGROUND OF THE INVENTION

1. Field of the Invention

The present invention relates to a power socket structure; in particular, it relates to a safe power socket capable of blocking the insertion of an alien body in case of incorrect operations.

2. Description of Related Art

There are numerous electric appliances in modern houses and environments, and countless electric power sockets also exist in such surroundings. Although the highly electrically developed world may provide a lot of conveniences for modern people's living styles, such benefits, on the contrary, may also undesirably cause certain risks, especially for younger children, who may ignorantly take various alien objects to poke the electric power socket simply because of curiosity thus possibly resulting in electric shock hazards.

As such, in order to improve the security in electric power usages and also prevent the potential danger of electric shock due to erroneously touching the electric power socket, a type of prior art security socket has been provided which essentially uses a case or a movable component to cover the electrode connected to electric power, and only when the plug holes of the electric power socket are correctly opened can the electric power plug be inserted into the power socket.

Although this type of prior art security socket may prevent the electric power plug from being arbitrarily inserted into the plug holes; however, so long as one of the plug holes is opened, the other one can be also exposed at the same time. Therefore, such a design may not offer sufficient safety to children, because kids could possibly use an alien object to stab or poke into any one of the plug holes; in case that the two plug holes are simultaneously opened, for the two electrodes in a typical residential power socket, one is called the "hot wire" and the other one is the ground wire (or referred as the "neutral wire"), the consequences of carelessly inserting and connecting to the hot wire with an alien object could be catastrophic.

Hence, it would be an optimal solution if a safe power socket can be devised, which can effectively block erroneous insertions into the plug hole thereby blocking the electric conduction in case just one of the plug holes is inserted.

In addition, the applicant of the present invention has filed the patent application Ser. No. 14/190,570 on Feb. 26, 2014.

SUMMARY OF THE INVENTION

The present invention relates to a power socket structure, which provides a safe power socket structure capable of blocking insertions of an alien body in case of incorrect operations.

The power socket structure according to the present invention can be coupled in inserted connection to an electric power plug including at least two electrode pins, comprising: a base seat, including a supportive platform as well as at least a first electrode and a second electrode for connecting to the electric power, wherein the supportive platform is located above the first electrode and the second electrode, and has a plane, a guide groove, a first through-hole and a second through-hole, in which the first through-hole is communicative to the first electrode and the second through-hole is communicative to the second electrode, the plane is connectedly adjacent to the guide groove and the plane and guide groove are configured between the first through-hole and the second through-hole, the guide groove has a tilted slope channel, and the end of the tilted slope channel has an accommodation part such that the position of the accommodation part is lower than the plane; a top lid, including at least a first plug-in hole and a second plug-in hole, in which the position of the first plug-in hole corresponds to the first electrode and the position of the second plug-in hole corresponds to the second electrode.

A safety gate, located between the top lid and the base seat, which slides on the surface of the supportive platform and includes a gate body and a rolling component installed between the gate body and the plane of the supportive platform, such that the rolling component can support the gate body so that the top end of the gate body sustains against the bottom plane of the top lid and the rolling component leans against and holds on the plane of the gate body thus allowing the top end of the gate body and the bottom end of the rolling component to respectively form a supportive point, and, under a normal condition, the safety gate is stably placed on the plane of the supportive platform and masks the first electrode and the second electrode at the same time; additionally, the gate body further includes a first slope and a first pierced hole, in which, under the normal condition, the high point of the first slope is close to the first plug-in hole of the top lid, and, after the at least two electrode pins of an electric power plug having been respectively inserted into the first plug-in hole and the second plug-in hole of the top lid, such at least two electrode pins can contact respectively with the first slope and the first pierced hole of the gate body, and by using the first slope, the first pierced hole as well as the rolling of the rolling component, the gate body can be pushed away from a normal position to an application position; and an elastic component, in which one end of the elastic component leans against and holds on the gate body, while the other end thereof leans against and holds on the inner plane of the top lid so as to keep the gate body to the normal position by means of the elastic force from the elastic component.

More specifically, for the above-said electric power plug, in case that only one of the electrode pins is inserted into the first plug-in hole or the second plug-in hole of the top lid and contacts the first slope or the first pierced hole, the gate body is maintained at the normal position.

More specifically, for the above-said power socket structure, at the normal position, in case that the at least two electrode pins of the electric power plug are respectively inserted into the first plug-in hole or the second plug-in hole of the top lid and contact the first slope and the first pierced hole of the gate body, the electrode pin in contact with the first slope of the gate body can use the first slope to push the gate body toward the application position and, at the same time, make the first pierced hole move to a position capable of contacting the other electrode pin.

More specifically, a recessed part is configured at the central position of the above-said first slope corresponding to the position of one of the two electrode pins in the electric power plug.

More specifically, at the position on the inner plane of the top lid corresponding to the gate body there includes a left slope and a right slope, and the left slope and the right slope are respectively configured on the two sides of a fulcrum located at the highest position where the left slope and the right slope are mutually engaged.

More specifically, the above-said gate body further includes a second slope, in which the position of the second slope corresponds to the position of the left slope, and a protrusion is formed on the gate body at the position where the first slope engages with the second slope such that the protrusion may slide on the left slope and, in case the gate body is pushed to the application position, get close to the fulcrum by means of the left slope in order to block the movement of the protrusion.

DETAILED DESCRIPTION OF THE PREFERRED EMBODIMENTS

Other technical contents, aspects and effects in relation to the present invention can be clearly appreciated through the detailed descriptions concerning the preferred embodiments of the present invention in conjunction with the appended drawings.

Figure 1:
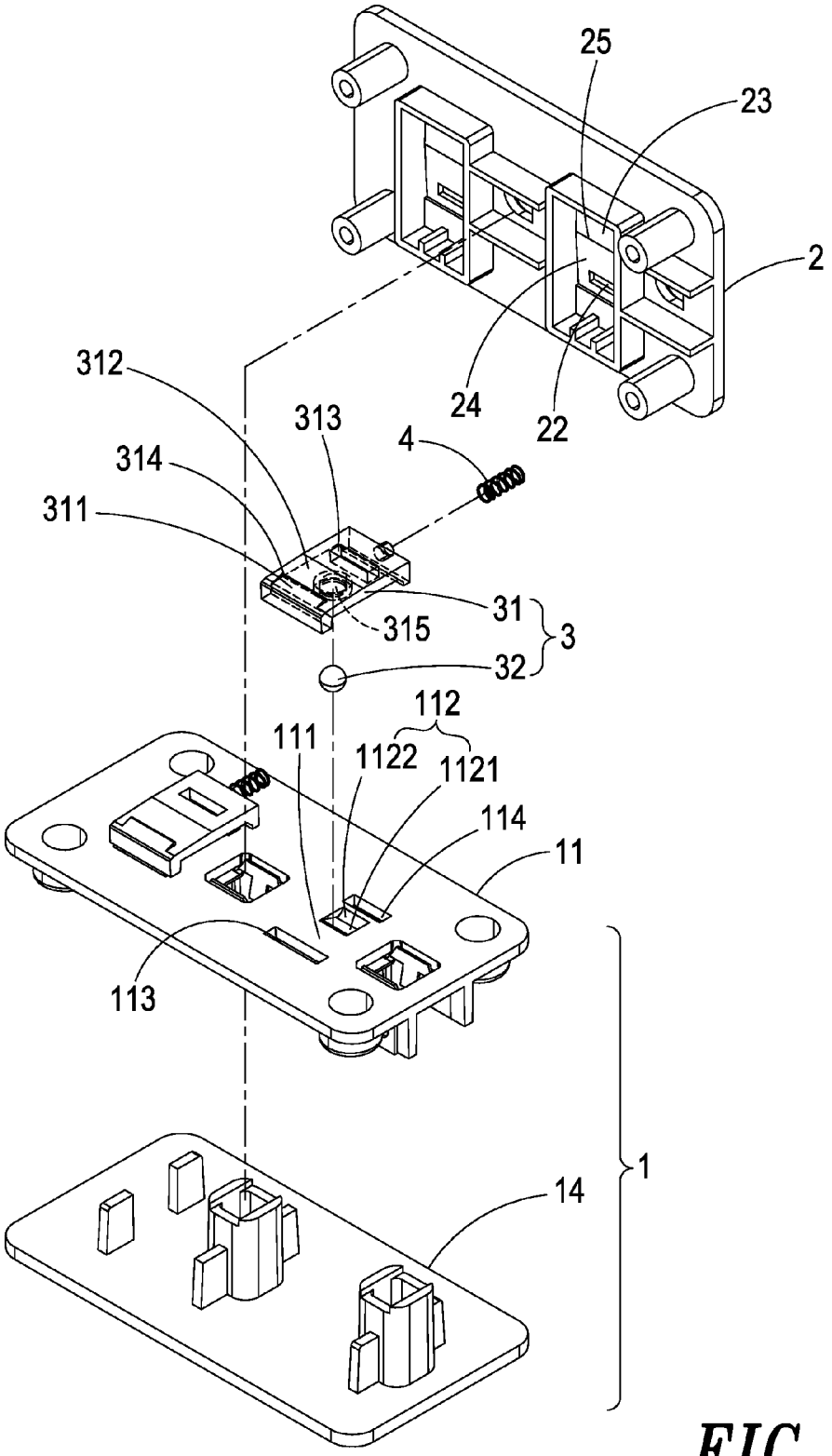
FIG. 1 shows a structural disassembly view of the power socket structure according to the present invention.
Figure 2:
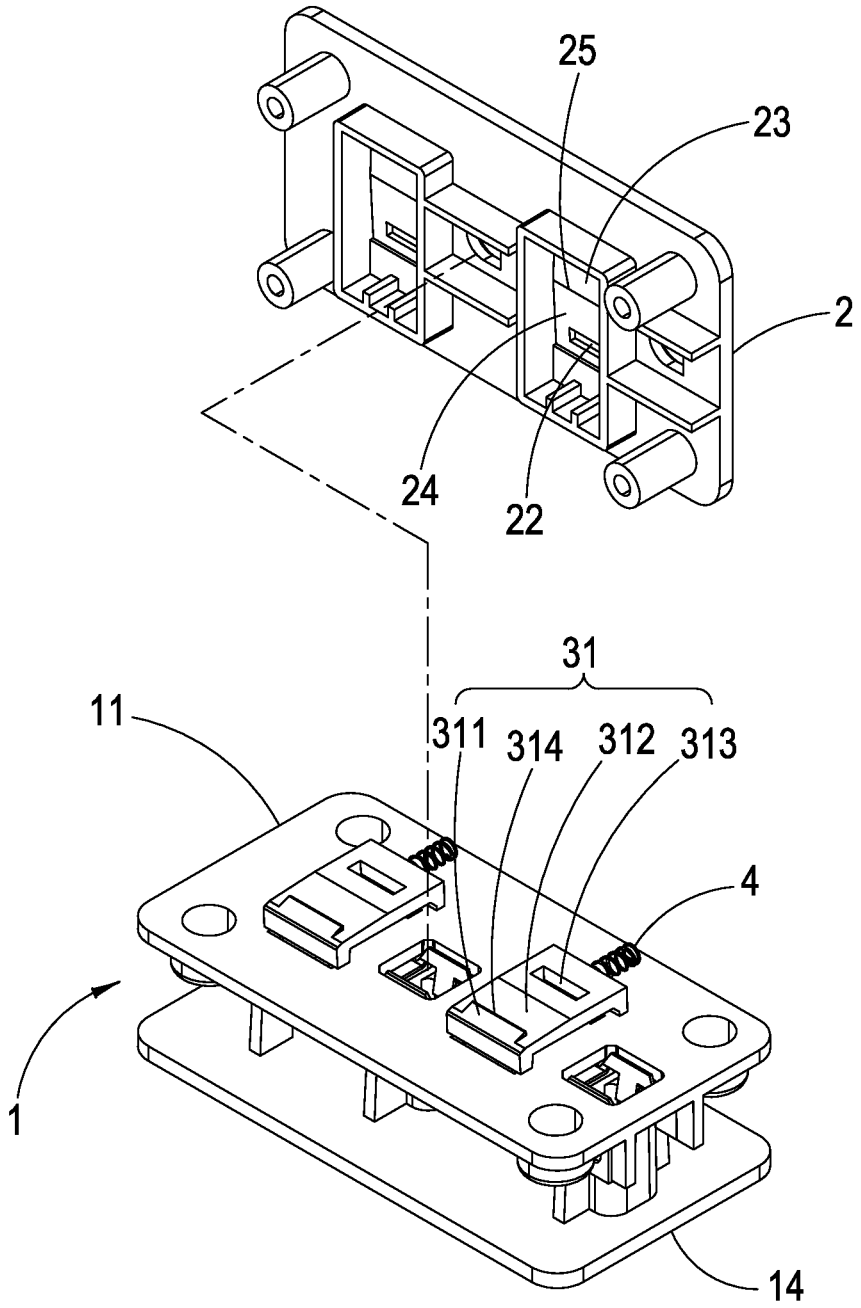
FIG. 2 shows a structural partial disassembly view of the power socket structure according to the present invention.
Figure 3:
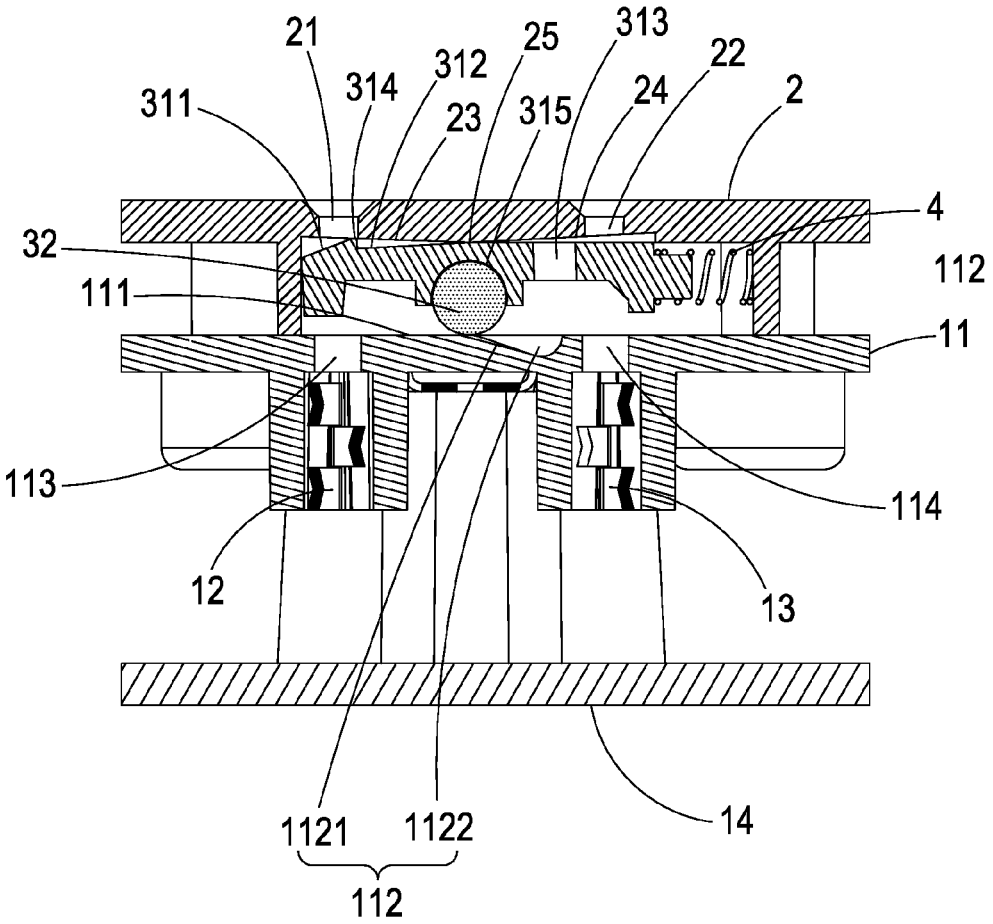
FIG. 3 shows a structural cross-section view of the power socket structure according to the present invention.

Refer initially to FIGS. 1-3, wherein a structural disassembly view, a structural partial disassembly view and a structural cross-section view of the power socket structure according to the present invention are respectively shown. It can be appreciated from the Figures that the power socket structure comprises a base seat 1, top lid 2, a safety gate 3 as well as an elastic component 4, in which the base seat 1 includes a supportive platform 11, a first electrode 12 and a second electrode 13 for connecting to the electric power and a grounding platform 14, wherein the supportive platform 11 is located above the first electrode 12 and the second electrode 13, and has a plane 111, a guide groove 112, a first through-hole 113 and a second through-hole 114, in which the first through-hole 113 is communicative to the first electrode 12 and the second through-hole 114 is communicative to the second electrode 13; additionally, the plane 111 is connectedly adjacent to the guide groove 112 and the plane 111 and guide groove 112 are configured between the first through-hole 113 and the second through-hole 114; besides, the guide groove 112 has a tilted slope channel 1121, and the end of the tilted slope channel 1121 has an accommodation part 1122 such that the position of the accommodation part 1122 is lower than the plane 111.

With regards to the at least a first electrode 12 and a second electrode 13 for electric power connections, taking an AC (alternative current) electric power socket having two electrode plug-in holes as an example, one of the first electrode 12 and the second electrode 13 is connected to the hot wire, while the other one connected to the neutral wire (grounding line); in an embodiment of the present invention, the safe power socket may be also an AC power socket including three power plug-in holes, i.e. having an additional third electrode.

Moreover, the top lid 2 includes at least a first plug-in hole 21 and a second plug-in hole 22, in which the position of the first plug-in hole 21 corresponds to the first electrode 12 and the position of the second plug-in hole 22 corresponds to the second electrode 13. When an electric power plug is correctly inserted into the power socket structure, one electrode pin of the electric power plug can be coupled in inserted connection to the first electrode 12 through the first plug-in hole 21, while the other electrode pin of the power plug coupled in inserted connection to the second electrode 13 through the second plug-in hole 22.

Moreover, at the position on the inner plane of the top lid 2 corresponding to the gate body 31 there includes a left slope 23 and a right slope 24, in which the left slope 23 and the right slope 24 are respectively configured on the two sides of a fulcrum 25, and the fulcrum 25 is located at the highest position where the left slope 23 and the right slope 24 are mutually engaged.

Herein the safety gate 3 is an electrically insulated component having a flake-like shape and located between the top lid 2 and the base seat 1. The safety gate 3 includes a gate body 31 and a rolling component 32, in which the rolling component 32 is located within the recessed hole 315 and configured between the gate body 31 and the plane 114 of the supportive platform 11, such that the rolling component 32 can tightly support the gate body 31 so that the top end of the gate body 31 sustains against the bottom plane of the top lid, and the rolling component 32 leans against and holds on the plane 111 of the base seat 1 thus allowing the top end of the gate body and the bottom end of the rolling component 32 to respectively form a supportive point. Under a normal condition, the gate body 31 is located between the top lid 2 and the base seat 1 and stably positioned, like a balance, on the plane 111 of the supportive platform 11, and also masks the first electrode 12 and the second electrode 13. Additionally, the gate body 31 further includes a first slope 311, a second slop 312 and a first pierced hole 313, wherein, under the normal condition, the high point of the first slope 311 is close to the first plug-in hole 21 of the top lid 2, and after the at least two electrode pins of an electric power plug are respectively plugged into the first plug-in hole 21 and the second plug-in hole 22 of the top lid 2, such at least two electrode pins of an electric power plug can respectively contact the first slope 311 and the first pierced hole 313 of the gate body 31 and, by using the first slope 311, the first pierced hole 313 and the rolling of the rolling component 32, push the gate body 31 away from the normal position to an application position.

Moreover, the elastic component 4 may be a spring, and one end of the elastic component 4 leans against and holds on the gate body 31, while the other end thereof leans against and holds on any one of the inner plane of the top lid 2 or the base seat 1 so as to keep the gate body 31 to the normal position by means of the elastic force from the elastic component 4. At the normal position, the safety gate 3 can be, like a balance, stably placed between the plane 111 of the supportive platform 11 and the fulcrum 25, and mask the first electrode 12 and the second electrode 13.

Figure 4:
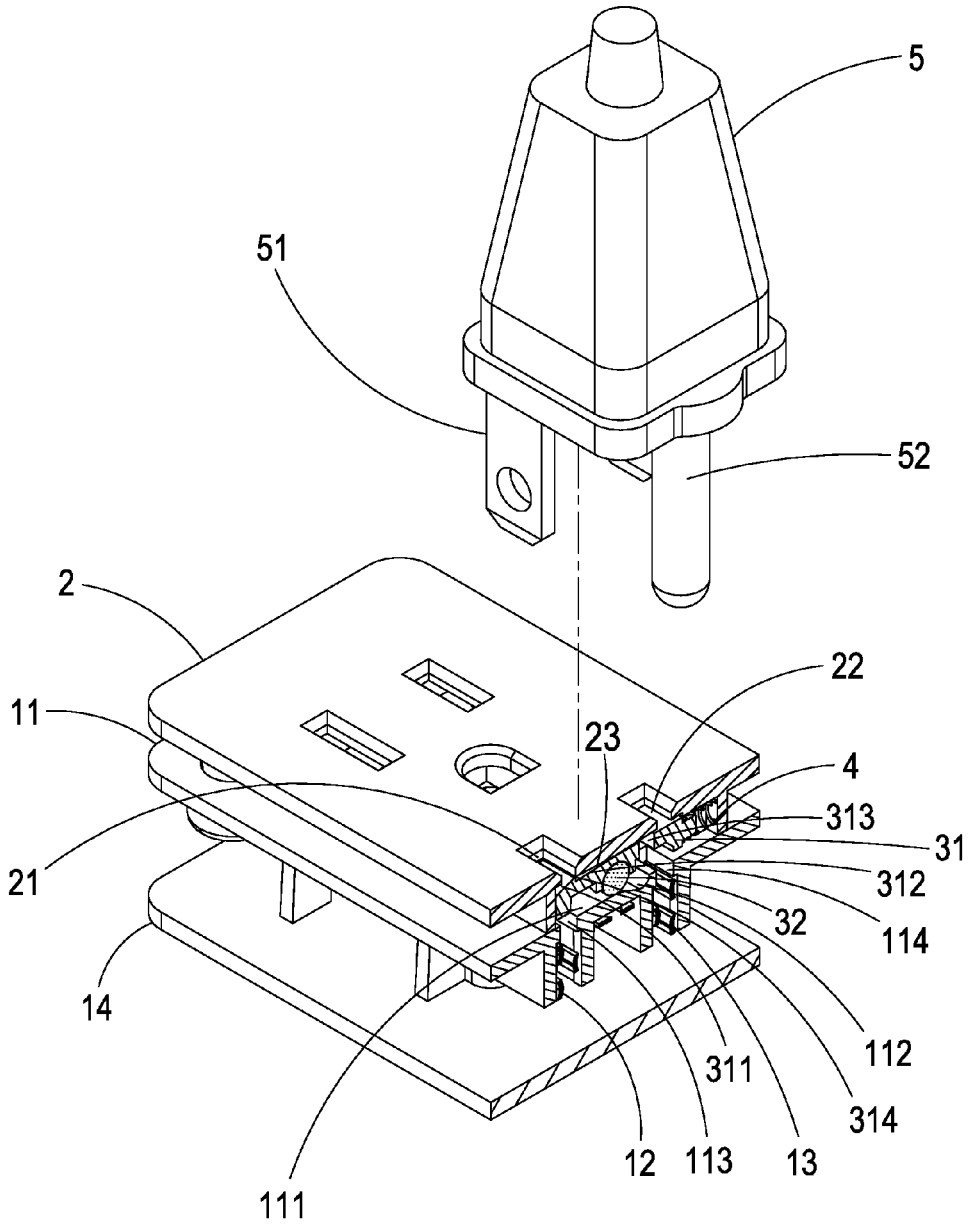
FIG. 4 shows a structural cross-section view of the power socket structure according to the present invention in conjunction with an electric power plug.
Figure 5A:
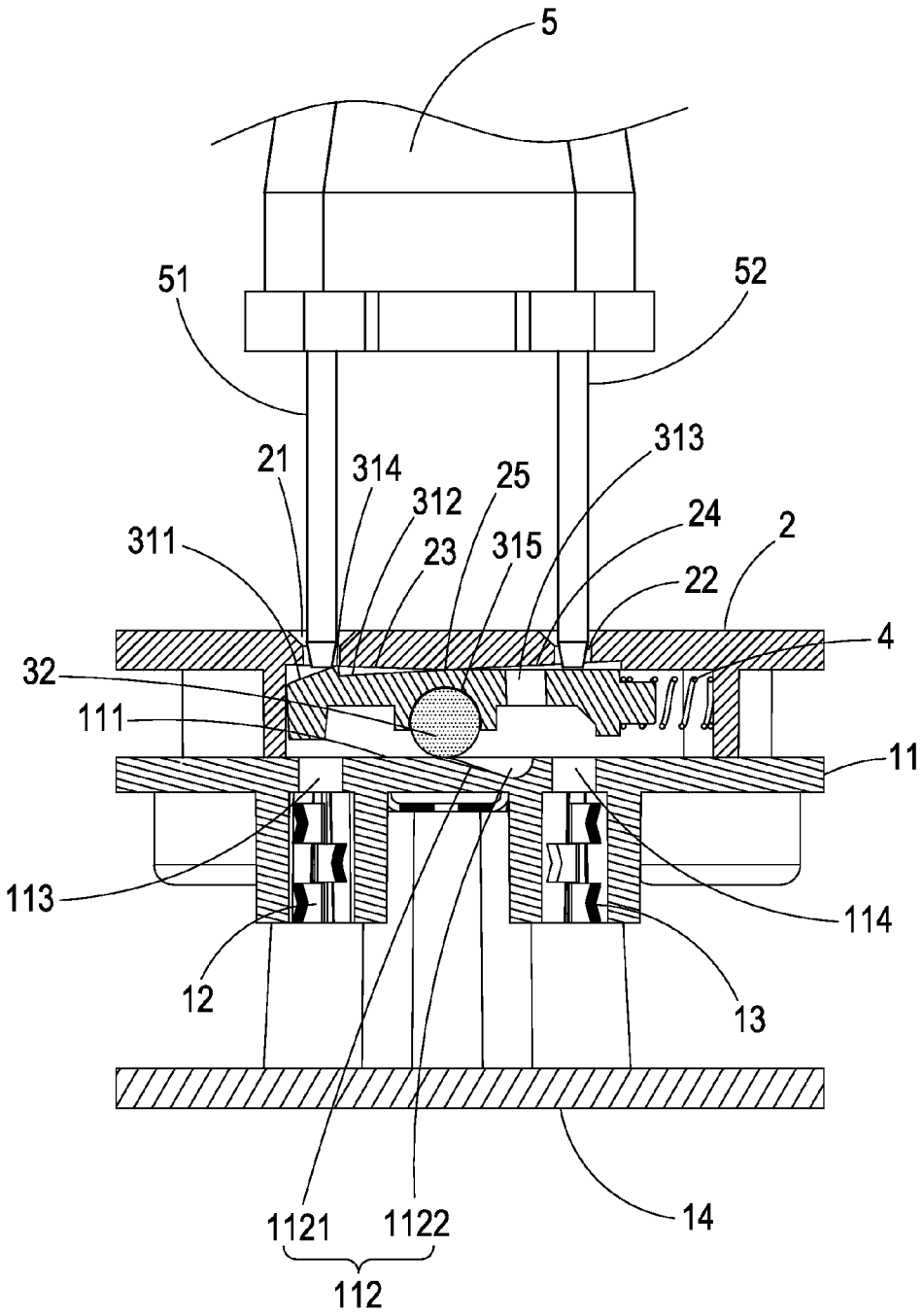
FIG. 5A shows a structural cross-section view of the power socket structure according to the present invention in conjunction with an electric power plug under the normal application condition.
Figure 5B:
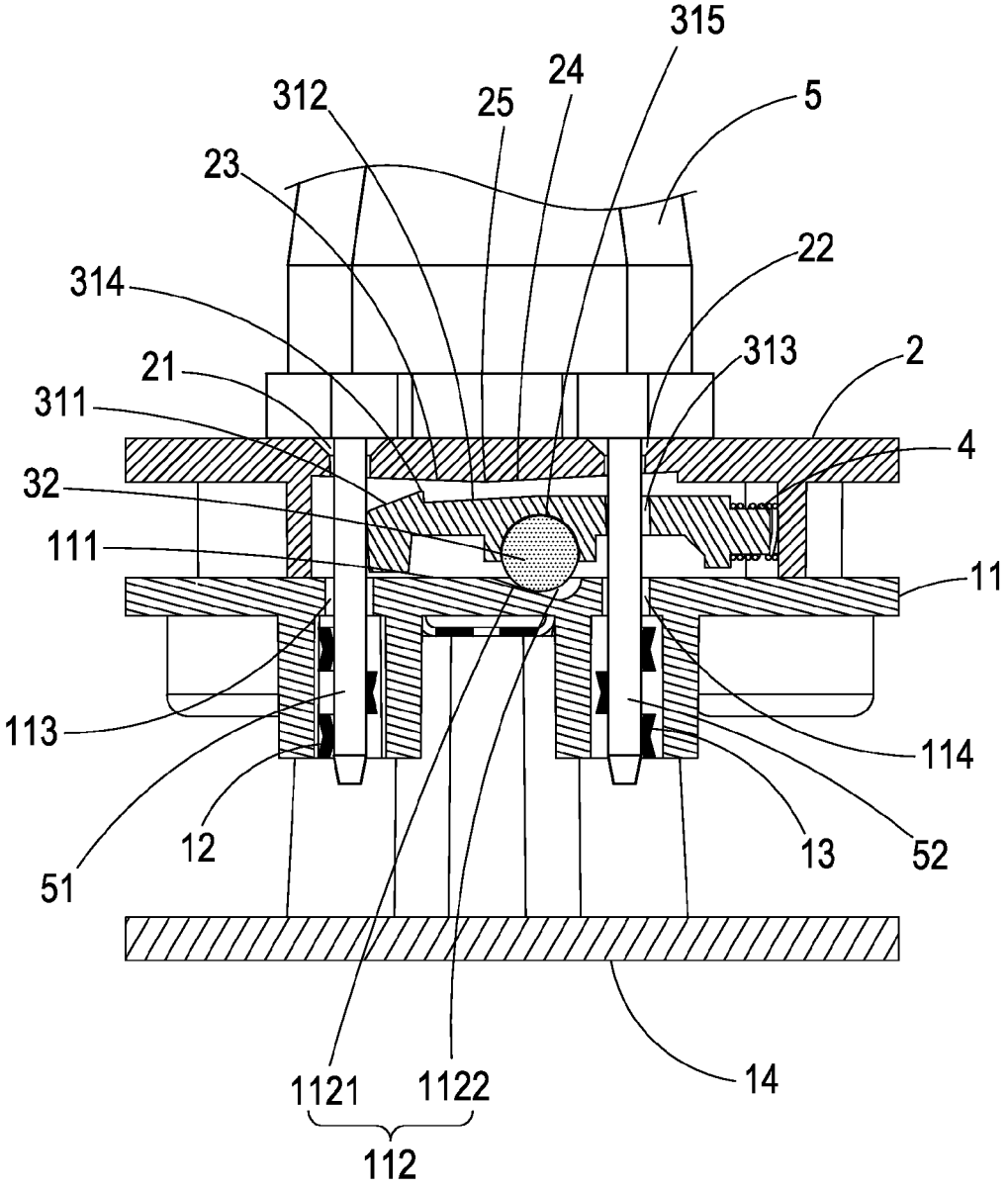
FIG. 5B shows a structural cross-section view of the power socket structure according to the present invention in conjunction with an electric power plug under the normal application condition.

According to an embodiment of the present invention, as shown in FIGS. 4, 5A and 5B, the first slope 311 of the gate body 31 has a positional difference along the slide direction of the gate body 31. More specifically, at the normal position, only one of the first slope 311 and the first pierced hole 313 of the gate body 31 may be exposed to the position in which any one of the at least two electrode pins 51, 52 of the electric power plug 5 can be in contact with.

In an exemplary structure according to the present invention as shown in FIGS. 5A and 5B, the first slope 311 corresponds to the position of the first plug-in hole 21 and the first pierced hole 313 corresponds to the position of the second plug-in hole 22. When the electric power plug 5 is correctly inserted into the power socket structure, the at least two electrode pins 51, 52 of the electric power plug 5 can engage with first slope 311 and the first pierced hole 313 in the gate body 31 at the same time, and, by using the push force from the at least two electrode pins 51, 52 of the electric power plug 5, the gate body 31 can be maintained in an equilibrium state, and one of the at least two electrode pins 51, 52 of the electric power plug 5 may be first in contact with the first slope 311. Thus, by further inserting the electric power plug 5 toward the power socket structure, it is possible to push the gate body 31 via the first slope 311 to make the rolling component 32 roll toward the guide groove 112, so the rolling component 32 can roll to the accommodation part 1122 by way of the tilted slope channel 1121 in the guide groove 112 and be positioned within the accommodation part 1122 in order that the top plane of the gate body 31 may disengage from the bottom plane of the top lid 2 and move in a direction departing from the normal position. Furthermore, the first pierced hole 313 of the gate body 31 can be moved to a position for contacting the other electrode pin thereby respectively pushing the first slope 311 and the first pierced hole 313 by means of the at least two electrode pins 51, 52 of the electric power plug 5 so as to drive the gate body 31 away from the normal position.

Also, regarding to the second slope 312 of the gate body 31, since the position of the second slope 312 corresponds to the position of the left slope 23 in the top lid 2 and a protrusion 314 is formed on the gate body 31 at the position where the first slope 311 and the second slope 312 engage, the protrusion 314 can slide on the left slope 23, and in case the gate body 31 is pushed to the application position, the movement of the protrusion 314 can be blocked by the left slope 23 near the fulcrum 25 such that the gate body 31 can be held at the application position.

Figure 6A:
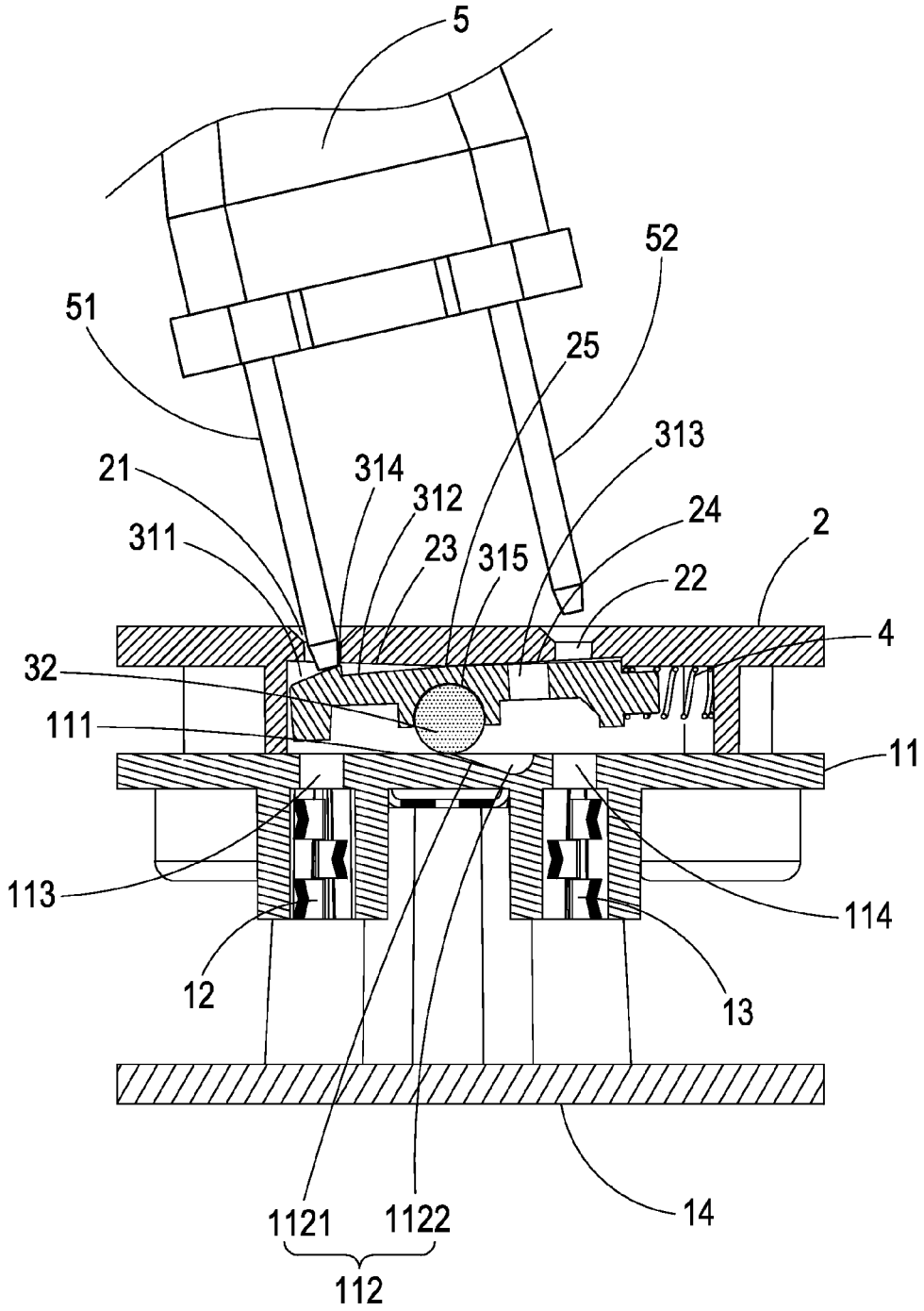
FIG. 6A shows a structural cross-section view of the power socket structure according to the present invention in conjunction with an electric power plug under the abnormal application condition.

In an embodiment of the safe power socket according to the present invention, as shown in FIG. 6A, if only the first electrode pin 51 of the electric power plug 5 is inserted into the first plug-in hole 21 thus being in contact with the first slope 311, the side contacting the first slope 311 may be pressed down but the other side regarding to the first pierced hole 313 now may rise up, so it is impossible to continue to insert the first electrode pin 51 downward into the first plug-in hole 21. In this way, the gate body 31 can not be inserted into the first through-hole 113 and the second through-hole 114; hence, it is unable to contact the first electrode 12 and the second electrode 13 for electric conduction thereby preventing the alien object from contacting the first electrode 12.

Figure 6B:
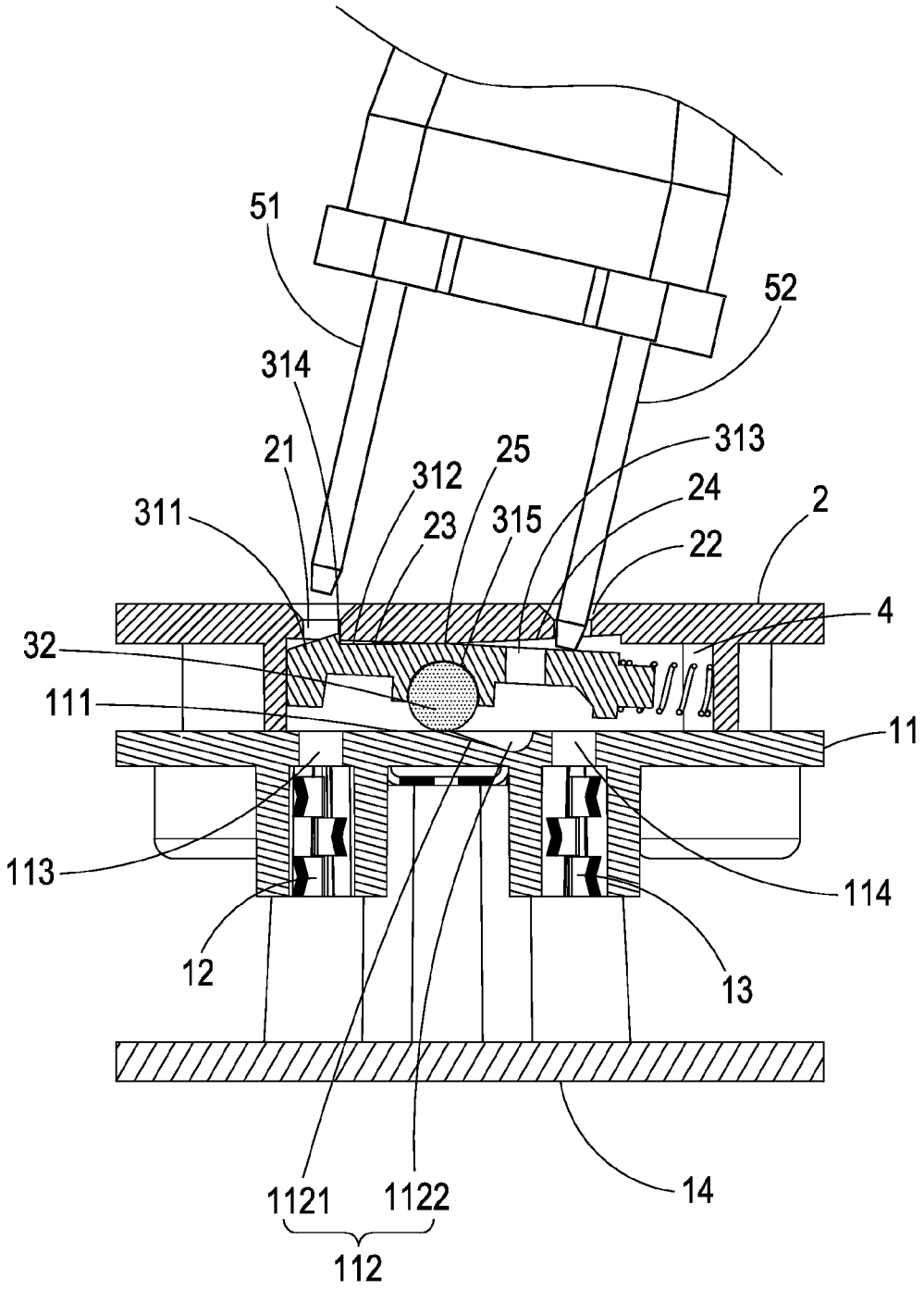
FIG. 6B shows a structural cross-section view of the power socket structure according to the present invention in conjunction with an electric power plug under the abnormal application condition.

On the other hand, as shown in FIG. 6B, suppose now only the second electrode pin 52 of the electric power plug 5 is inserted into the second plug-in hole 22 thus being in contact with the first pierced hole 313, the side contacting the first pierced hole 313 may be pressed down but the other side regarding to the first slope 311 may rise up, thus the protrusion 314 is stuck in the first plug-in hole 21, so it is impossible to continue to insert the second electrode pin 52 downward into the second plug-in hole 22. Accordingly, the gate body 31 can not be inserted into the first through-hole 113 and the second through-hole 114; consequently, it is unable to contact the first electrode 12 and the second electrode 13 for electric conduction thereby preventing the alien object from contacting the second electrode 12.

Moreover, the aforementioned rolling component 32 may be any one of the following: beads or metallic beads or else a ball or a metallic ball, or the like.

In comparison with other conventional technologies, the power socket structure according to the present invention provides the following advantages:

1. In the present invention, if any one of the first plug-in hole or the second plug-in hole is inserted, it can sway about the rolling component of the safety gate acting as the center thereby maintaining the relationship of masking the first electrode and the second electrode; therefore, only when the electric power plug is correctly inserted can it be possible to push the safety gate away from the normal position to an application position via the first slope, thereby effectively preventing an alien object from being inserted into the power socket structure;

2. Although the present invention has been disclosed through the detailed descriptions of the aforementioned embodiments, such illustrations are by no means used to restrict the present invention. Skilled ones in relevant fields of the present invention can certainly devise any applicable alternations and modifications after comprehending the aforementioned technical characteristics and embodiments of the present invention without departing from the spirit and scope thereof. Hence, the scope of the present invention to be protected under patent laws should be delineated in accordance with the claims set forth hereunder in the present specification.

What is claimed is:

1. A power socket structure, which can be coupled in inserted connection to an electric power plug including at least two electrode pins, comprising:

a base seat, including a supportive platform as well as at least a first electrode and a second electrode for connecting to the electric power, wherein the supportive platform is located above the first electrode and the second electrode, and has a plane, a guide groove, a first through-hole and a second through-hole, in which the first through-hole is communicative to the first electrode and the second through-hole is communicative to the second electrode; additionally, the plane is connectedly adjacent to the guide groove and the plane and guide groove are configured between the first through-hole and the second through-hole; besides, the guide groove has a tilted slope channel, and the end of the tilted slope channel has an accommodation part such that the position of the accommodation part is lower than the plane;

a top lid, including at least a first plug-in hole and a second plug-in hole, in which the position of the first plug-in hole corresponds to the first electrode and the position of the second plug-in hole corresponds to the second electrode;

a safety gate, located between the top lid and the base seat, which slides on the surface of the supportive platform and includes a gate body and a rolling component installed between the gate body and the plane of the supportive platform, such that the rolling component can support the gate body so that the top end of the gate body sustains against the bottom plane of the top lid and the rolling component leans against and holds on the plane of the base seat thus allowing the top end of the gate body and the bottom end of the rolling component to respectively form a supportive point, and, under a normal condition, the safety gate is stably placed on the plane of the supportive platform and masks the first electrode and the second electrode at the same time; additionally, the gate body further includes a first slope and a first pierced hole, in which, under the normal condition, the high point of the first slope is close to the first plug-in hole of the top lid, and, after the at least two electrode pins of an electric power plug having been respectively inserted into the first plug-in hole and the second plug-in hole of the top lid, such at least two electrode pins can contact respectively with the first slope and the first pierced hole of the gate body, and by using the first slope, the first pierced hole as well as the rolling of the rolling component, the gate body can be pushed away from a normal position to an application position; at the application position, the rolling component moves toward the guide groove such that the rolling component can be positioned into the accommodation part via the tilted slope channel; and an elastic component, in which one end of the elastic component leans against and holds on the gate body, while the other end thereof leans against and holds on the inner plane of the top lid so as to keep the gate body to the normal position by means of the elastic force from the elastic component.

2. The power socket structure according to claim 1, wherein, in case that only one of the electrode pins in the electric power plug is inserted into the first plug-in hole or the second plug-in hole of the top lid and contacts the first slope or the first pierced hole, the gate body is maintained at the normal position.

3. The power socket structure according to claim 1, wherein, at the normal position, in case that the at least two electrode pins of the electric power plug are respectively inserted into the first plug-in hole or the second plug-in hole of the top lid and contact the first slope and the first pierced hole of the gate body, the electrode pin in contact with the first slope of the gate body can use the first slope to push the gate body toward the application position and, at the same time, make the first pierced hole move to a position capable of contacting the other electrode pin.

4. The power socket structure according to claim 1, wherein at the position on the inner plane of the top lid corresponding to the gate body there includes a left slope and a right slope, and the left slope and the right slope are respectively configured on the two sides of a fulcrum located at the highest position where the left slope and the right slope are mutually engaged.

5. The power socket structure according to claim 4, wherein the gate body further includes a second slope, the position of the second slope corresponds to the position of the left slope, and a protrusion is formed on the gate body at the position where the first slope engages with the second slope such that the protrusion may slide on the left slope and, in case the gate body is pushed to the application position, get close to the fulcrum by means of the left slope in order to block the movement of the protrusion.

6. The power socket structure according to claim 1, wherein the rolling component may be one of the following: beads or metallic beads or else a ball or a metallic ball.

* * * * *